US010030331B2

(12) United States Patent
Lee

(10) Patent No.: US 10,030,331 B2
(45) Date of Patent: Jul. 24, 2018

(54) STEAM IRON

(71) Applicant: ATIED CORPORATION, Goyang-si, Gyeonggi-do (KR)

(72) Inventor: Jung Kyu Lee, Goyang-si (KR)

(73) Assignee: NEXT UP CO., LTD., Goyang-si (KR)

( * ) Notice: Subject to any disclaimer, the term of this patent is extended or adjusted under 35 U.S.C. 154(b) by 81 days.

(21) Appl. No.: 14/374,940

(22) PCT Filed: Jan. 8, 2014

(86) PCT No.: PCT/KR2014/000168
§ 371 (c)(1),
(2) Date: Jun. 27, 2016

(87) PCT Pub. No.: WO2015/064843
PCT Pub. Date: May 7, 2015

(65) Prior Publication Data

US 2016/0289889 A1 Oct. 6, 2016

(30) Foreign Application Priority Data

Oct. 30, 2013 (KR) ..... 10-2013-0130585

(51) Int. Cl.
*D06F 75/14* (2006.01)
*D06F 75/38* (2006.01)

(52) U.S. Cl.
CPC ..... *D06F 75/14* (2013.01); *D06F 75/38* (2013.01)

(58) Field of Classification Search
CPC ..... D06F 75/14; D06F 75/18; D06F 75/20; D06F 75/38
(Continued)

(56) References Cited

U.S. PATENT DOCUMENTS 1,858,250 A * 5/1932 Smith ..... D06F 75/38 38/97
2,637,125 A * 5/1953 Roberts ..... D06F 75/30 38/77.3
(Continued)

FOREIGN PATENT DOCUMENTS

CN 201411579 Y 2/2010
CN 201972040 U 9/2011
(Continued)

OTHER PUBLICATIONS

Japan Patent Office, Communication dated Aug. 25, 2015, issued in corresponding Japanese Application No. 2014-212245.
(Continued)

*Primary Examiner* — Ismael Izaguirre
(74) *Attorney, Agent, or Firm* — Sughrue Mion, PLLC

(57) ABSTRACT

The present invention relates to a steam iron, including: a body part in which a water tank for storing water and a steam generating device for converting water supplied from the water tank into steam are installed; a main hot plate part which is installed at one side of the body part and formed with a plurality of main steam outlets for discharging steam generated by the steam generating device; and a hot plate cover part which includes an auxiliary hot plate formed with an auxiliary steam outlet through which steam discharged from the plurality of main steam outlets is discharged, and detachably coupled with the body part.

4 Claims, 4 Drawing Sheets

(58) Field of Classification Search
USPC ..... D32/68, 70
See application file for complete search history.

(56) References Cited

U.S. PATENT DOCUMENTS

| | | | | | |
|---|---|---|---|---|---|
| 4,642,922 | A | * | 2/1987 | Prudenziati | D06F 75/20 38/81 |
| D312,905 | S | * | 12/1990 | Davidson | D32/71 |
| 5,815,962 | A | * | 10/1998 | Emberson-Nash | D06F 75/38 38/97 |
| 5,987,788 | A | * | 11/1999 | Doyel | D06F 5/38 38/97 |
| 7,640,686 | B2 | * | 1/2010 | Wai | D06F 71/02 38/81 |
| 2003/0188464 | A1 | * | 10/2003 | Doria | D06F 75/38 38/81 |
| 2008/0168688 | A1 | * | 7/2008 | Hahn | D06F 75/10 38/77.8 |
| 2010/0000130 | A1 | * | 1/2010 | Ng | D06F 75/12 38/77.83 |

FOREIGN PATENT DOCUMENTS

| | | | | |
|---|---|---|---|---|
| CN | 102713048 | A | | 10/2012 |
| CN | 202786862 | U | | 3/2013 |
| JP | 58-23599 | U | | 2/1983 |
| JP | 62-26100 | A | | 2/1987 |
| JP | 01201300 | | * | 8/1989 |
| JP | 10-71076 | A | | 3/1998 |
| KR | 20-0347461 | B1 | | 4/2004 |
| KR | 20-0439142 | B1 | | 3/2008 |
| KR | 20-0448256 | A | | 3/2010 |
| KR | 10-2011-0138470 | A | | 12/2011 |
| KR | 10-1156762 | B1 | | 6/2012 |

OTHER PUBLICATIONS

Communication dated Mar. 31, 2016, from the State Intellectual Property Office of the People's Republic of China in counterpart application No. 201480000511.1.

Korean Intellectual Property Office , Communication dated Aug. 22, 2014 issued in corresponding Korean application No. 10-2013-0130585.

International Searching Authority, International Search Report dated Jul. 25, 2014 issued in corresponding application No. PCT/KR2014/000168.

http://www.ihaan.com/index.html.2013.04 Haan Corporation, 4 pages total.

* cited by examiner

[Fig.1]
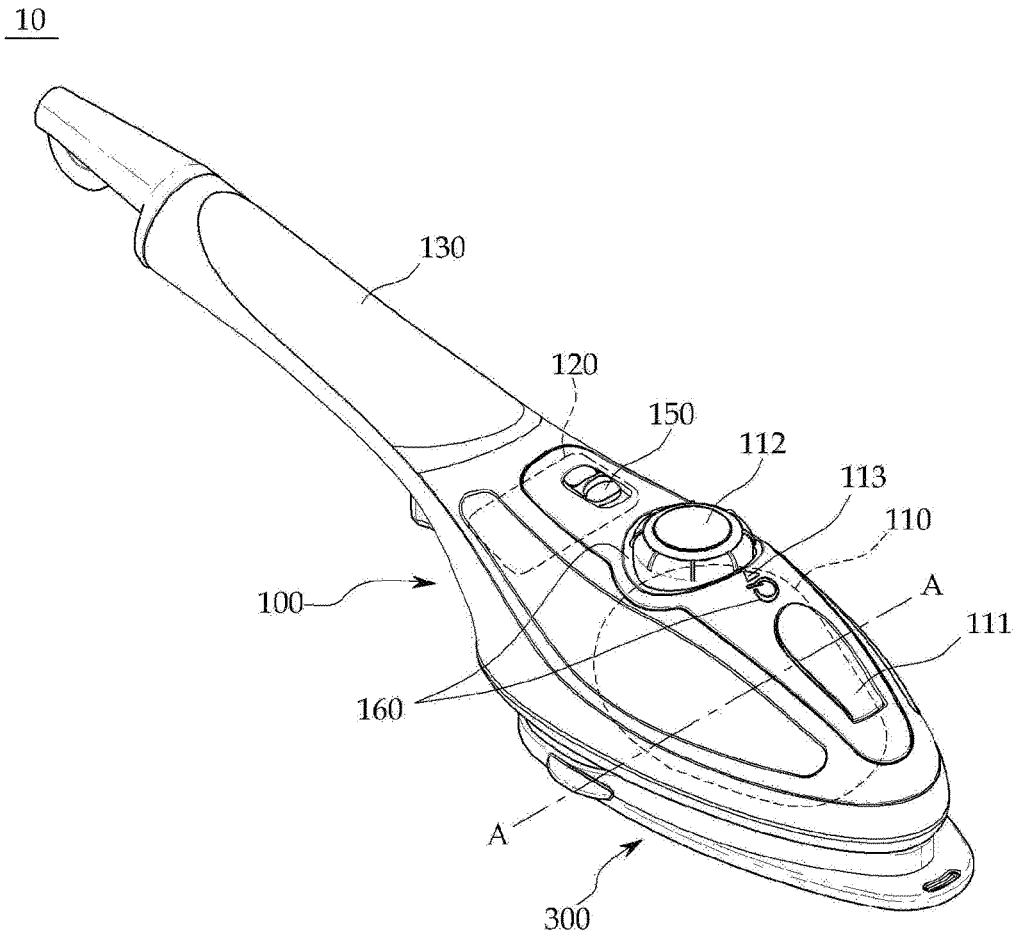

[Fig.2]
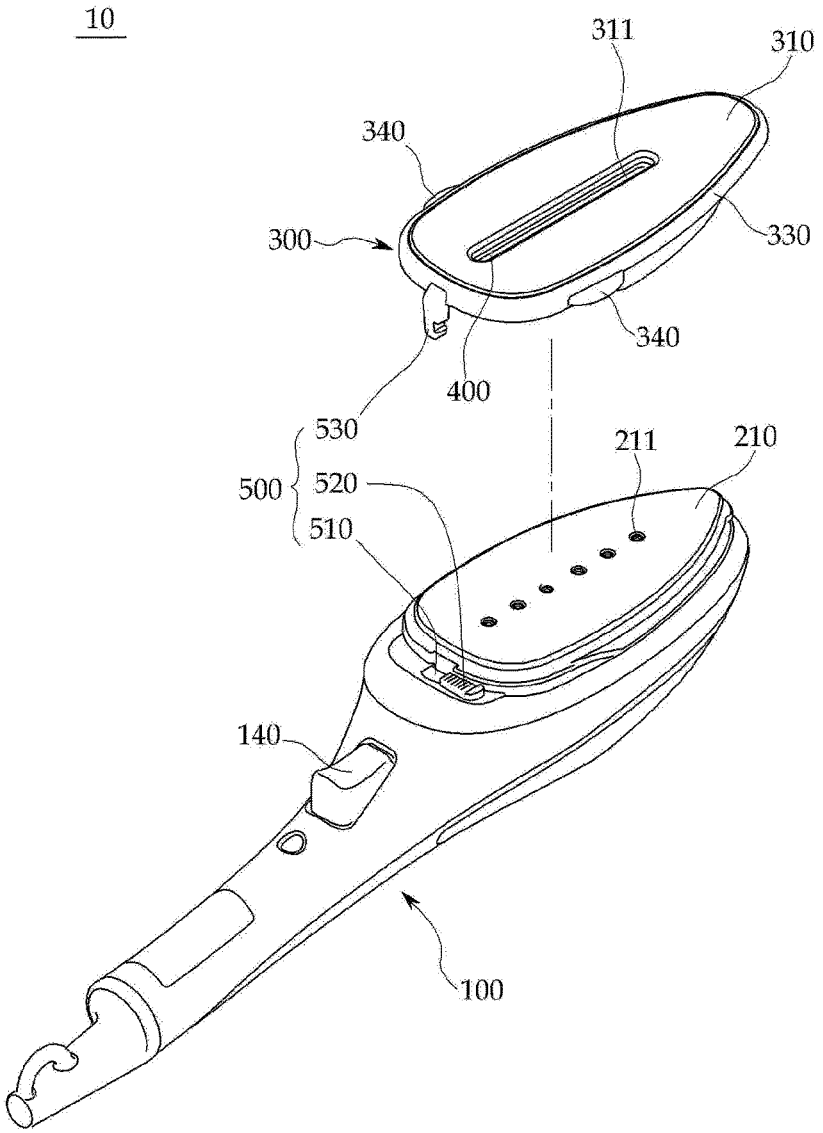

[Fig.3]
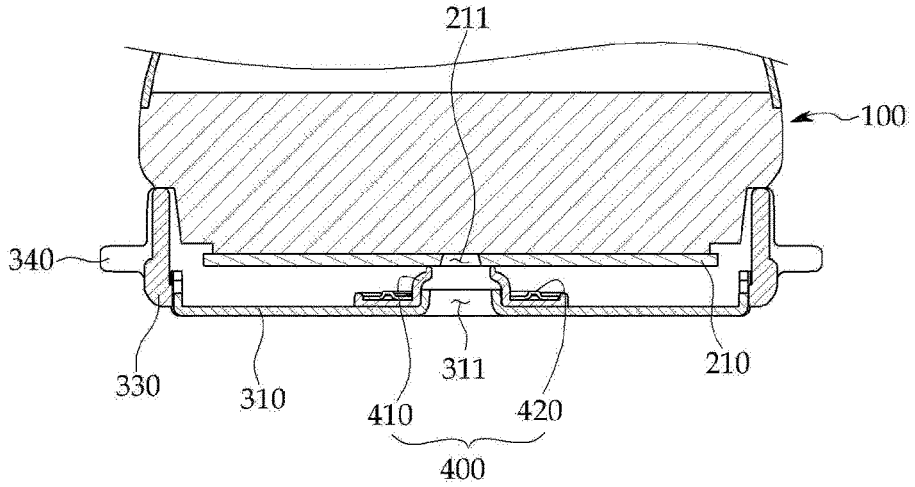

[Fig.4]
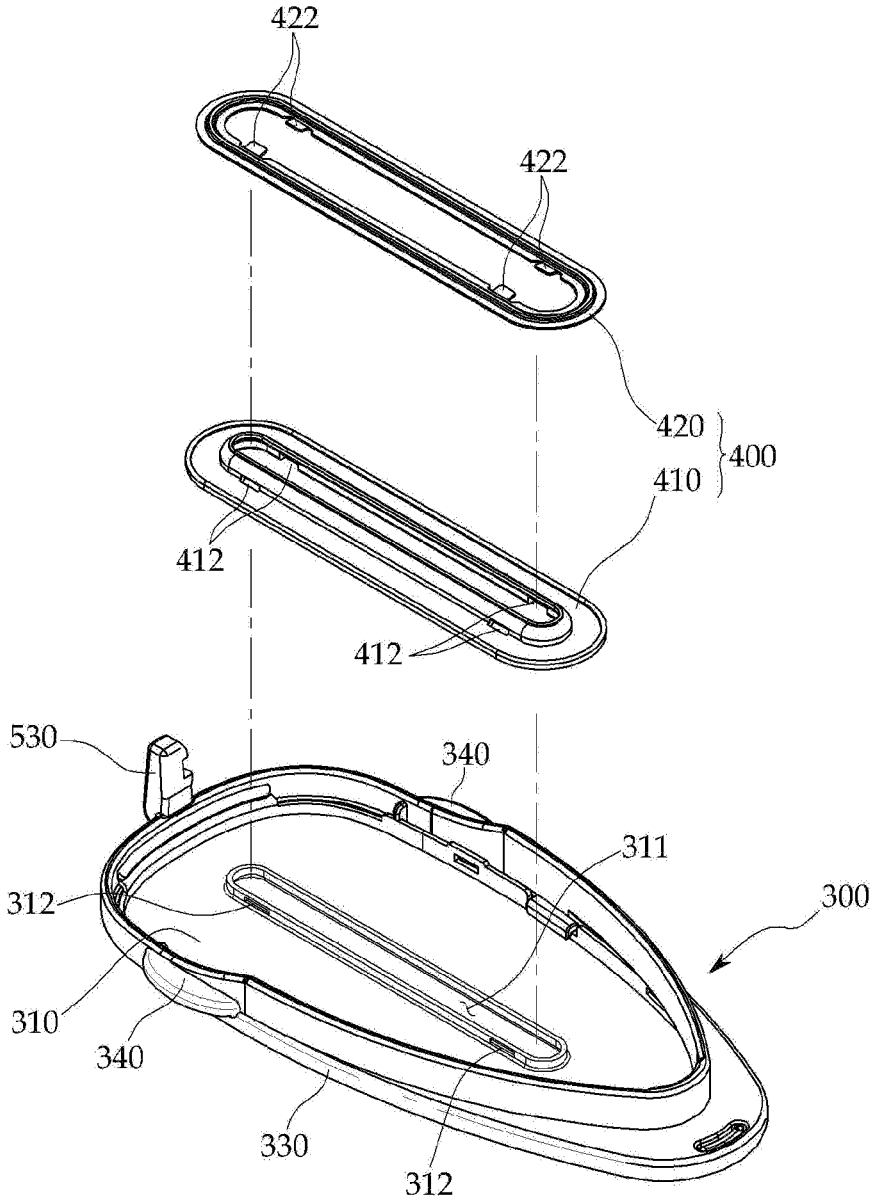

STEAM IRON

TECHNICAL FIELD

The present invention relates to a steam iron, and more particularly, to a steam iron including a hot plate cover part detachably coupled with a body part.

BACKGROUND ART

In general, a steam iron is used for ironing wrinkles formed at cloth or clothes by spraying steam. The steam iron may decrease damage to cloth, and effectively iron wrinkles formed at adornment, such as a frill, of clothes, compared to a general iron for ironing wrinkles by pressing cloth.

However, the steam iron in the related art has a problem in that a water tank provided so as to generate steam is installed outside a body part of the steam iron, so that it is inconvenient to move and keep the steam iron.

Further, when a user irons cloth or clothes so as to crimp the cloth or clothes by using the steam iron in the related art, it is difficult to crimp the cloth or clothes by ironing at different ironing temperatures according to the kinds of cloth, so that there is a problem in that the cloth is melt by a heated hot plate of the steam iron which may be damaged when the cloth contains silk, nylon, polyester, and the like.

DISCLOSURE

Technical Problem

The present invention provides a steam iron, which is conveniently moved and kept, and is capable of preventing damage to cloth, and crimping cloth.

Technical Solution

According to an exemplary embodiment of the present invention, a steam iron includes: a body part in which a water tank for storing water and a steam generating device for converting water supplied from the water tank into steam are installed; a main hot plate part which is installed at one side of the body part and formed with a plurality of main steam outlets for discharging steam generated by the steam generating device; and a hot plate cover part which includes an auxiliary hot plate formed with an auxiliary steam outlet through which steam discharged from the plurality of main steam outlets is discharged, and is detachably coupled with the body part.

Further, the auxiliary hot plate may be spaced apart from the main hot plate part in a state where the hot plate cover part is mounted in the body part, and may be heated by receiving heat energy generated by the main hot plate part.

Further, the body part may further include a continuous steam spray button part by which steam is continuously discharged from the plurality of main steam outlets.

Further, the body part may further include a light emission unit which emits light when steam is continuously discharged from the plurality of main steam outlets by an operation of the continuous steam spray button part.

Further, the hot plate cover part may further include an airtight part which guides steam discharged from the plurality of main steam outlets to the auxiliary steam outlet.

Further, the airtight part may include a seal member which is installed to protrude at one side of an outer peripheral surface of the auxiliary steam outlet, and a bracket member which couples the seal member to the auxiliary hot plate.

Advantageous Effects

According to the exemplary embodiments of the present invention, the steam iron may be conveniently moved and kept, and crimp cloth while preventing cloth from being damaged.

DESCRIPTION OF DRAWINGS

FIG. 1 is a perspective view illustrating a steam iron according to an exemplary embodiment of the present invention.

FIG. 2 is an exploded perspective view of FIG. 1.

FIG. 3 is a cross-sectional view taken along line A-A of FIG. 1.

FIG. 4 is an exploded perspective view of an airtight part of FIG. 1.

MODE FOR INVENTION

Hereinafter, an exemplary embodiment of the present invention will be described in detail with reference to the accompanying drawings so that those skilled in the art may easily carry out the present invention. The present invention may be modified implemented in various different ways, all without departing from the spirit or scope of the present invention and is not limited to exemplary embodiment described herein.

It is noted that the drawings are schematic and are not dimensionally illustrated. A relative size and a ratio of elements in the drawings are exaggerated or decreased in a size for clearness and convenience in the drawings for illustration, and a predetermined size is simply illustrative, and is not limited. In addition, the same reference numerals designate the same structures, elements, or parts illustrated in the two or more drawings in order to exhibit similar characteristics.

An exemplary embodiment of the present invention represents an ideal exemplary embodiment of the present invention. As a result, various modifications of the drawings are expected. Accordingly, the exemplary embodiment is not limited to a specific form of the illustrated region, and for example, includes a modification of a form by manufacturing.

Hereinafter, a steam iron 10 according to an exemplary embodiment of the present invention will be described with reference to FIGS. 1 to 4.

The steam iron 10 according to the exemplary embodiment of the present invention includes a body part 100, a main hot plate part 210 formed with a main steam outlet, and a hot plate cover part 300.

As illustrated in FIG. 1, the body part 100 of the steam iron 10 according to the exemplary embodiment of the present invention includes a water tank 110 and a steam generating device 120.

The water tank 110 is installed inside the body part, and stores water supplied from the outside. Further, the body part 100 may further include a stopper 111 connected to the water tank 110 and capable of being opened/closed.

Particularly, the water tank 110 may be installed on the body part 100, and the stopper 111, which may be opened and closed, is installed on one surface of the water tank 110 so as to be connected with the water tank 110, thereby enabling a user to easily supply water to the water tank 110.

That is, the water tank 110 is installed in the body part 100, so that the steam iron has a smaller volume than that of the steam iron in the related art, in which a separate water tank is formed outside a body part, thereby being easily kept and moved.

The steam generating device 120 is installed in the body part 100, and converts water supplied from the water tank 110 into steam. The steam generating device 120 may heat a path, in which water moves, by a heating device to convert water supplied at a predetermined water pressure into steam.

The steam generating device 120 according to the exemplary embodiment of the present invention is not limited to the steam generating device 120, which generates steam by heating the water supplied at the predetermined water pressure by the heating device, and may be changed to various structures publicly known to those skilled in the art, which is capable of converting water supplied from the water tank 110 into steam, to be implemented.

Further, the body part 100 may further include a handle part 130, a temperature controller 112, a display unit 113, a continuous steam spray button part 150, and a light emission unit 160.

The handle part 130 may be formed so as to enable a user to safely grip the steam iron, and protrude in a predetermined direction of the body part 100. That is, the handle part 130 is formed at the body part 100, so that the user may easily use the steam iron.

Particularly, the body part 100 may be elongated in a predetermined direction.

The temperature controller 112 may control a temperature generated by a heat generating device (not illustrated) which is installed at the body part 100.

Particularly, the temperature controller 112 may be formed at an upper end of the body part 100 so as to enable the user to easily operate the temperature controller 112. Further, the temperature controller 112 may be formed in a dial type, and gradations, lines with thickness, and the like may be printed on one surface of the temperature controller 112 so as to enable the user to easily recognize an increase/decrease in a temperature.

That is, the temperature controller 112 is formed at the body part 100, so that when the user crimps cloth by using the steam iron 10, the user may set an appropriate temperature.

The display unit 113 is formed to be spaced apart from the temperature controller 112, and guides a current setting value of the temperature controller 112, in which the gradations, lines with thickness, and the like are printed, so as to enable an operator to recognize the current setting value.

The continuous steam spray button part 150 is formed at the body part 100. Particularly, when the continuous steam spray button part 150 is operated by the user during the steam ironing, steam may be continuously sprayed through main steam outlets 221 (illustrated in FIG. 2).

As one example, the continuous steam spray button part 150 may be formed in the form of a toggle switch to be adjacently disposed to the temperature controller 112, and be turned on/off according to a necessity of the user.

Accordingly, when the user desires to perform ironing requiring continuous steam spray, the user may iron by operating the continuous steam spray button part 150, so that the user may conveniently iron without repeatedly operating the steam spray button for the continuous steam spray.

The light emission unit 160 is formed at the body part 100. Further, the light emission unit 160 may emit light when the continuous steam spray button part 150 is operated by the user and steam is continuously discharged through the main steam outlets 221 (illustrated in FIG. 2).

Accordingly, the user may easily recognize on/off of the continuous steam spray button part 150 through lighting of the light emission unit 160. That is, the light emission unit 160 may guide the on/off operation of the continuous steam spray button part 160 to the user, thereby improving visibility.

Further, the light emission unit 160 may be adjacently formed to the temperature controller 112, or formed outside the body part 100 between the stopper 111 and the temperature controller 112.

Further, a plurality of light emission units 160 may be formed. Particularly, one or more light emission units 160 may be formed in a circular shape at the body part 100, which is adjacently formed to an outer peripheral surface of the temperature controller 112 formed in the dial type.

As illustrated in FIG. 2, in the steam iron 10 according to the exemplary embodiment of the present invention, the hot plate cover part 300 is detachably coupled with the body part 100.

A main hot plate part 210 formed with the plurality of main steam outlets 221 is installed at one side of the body part 100.

Particularly, the main hot plate part 210 may be installed under the body part 100, and heated by a non-illustrated heat generating device, such as a hot wire. That is, a material of the main hot plate part 210 includes a metal, and is directly heated by heat generated by the heat generating device, such as the hot wire.

Further, the main hot plate part 210 may be formed in a form in which one end in one direction opposite to the other direction, in which the handle part 130 of the body part 100 protrudes, becomes narrow.

As illustrated in FIG. 1, the steam generated by the steam generating device 120 may be discharged through the main steam outlets 221 formed at the main hot plate part 210. Accordingly, the steam iron 10 may iron wrinkles formed in the cloth by the steam discharged from the main steam outlets 221.

That is the user may iron the wrinkles formed in the cloth by using the steam discharged through the main steam outlets 221 while holding the handles part 130.

Further, the body part 100 may further include a steam spray button part 140.

When the user pressurizes the steam spray button part 140, steam is discharged through the main steam outlets 221.

Particularly, the steam spray button part 140 may be formed at a lower part of the handle part 130 so as to enable the user to easily pressurize the steam spray button part 140 according to a necessity of steam during ironing while holding the handle part 130.

When the user irons by using the steam iron, the user holds the handle part 130 and presses the main hot plate part 210 which is installed at the body part 100 and is heated, on the cloth, thereby crimping the cloth. In this case, the steam discharged from the main steam outlets 221 may be discharged through the user's operation of the steam spray button part 140.

Accordingly, the steam iron 10 according to the exemplary embodiment of the present invention may iron the wrinkles formed in the cloth by the steam discharged through the main steam outlets 221, and crimp the cloth by the heated main hot plate part 210.

That is, it is possible to iron the wrinkles formed in the cloth by the steam generated from the main steam outlets 221, and crimp dress slacks, a dress shirt, and the like by heat energy generated by the main heat plate part 210.

Further, it is possible to iron a narrow area, such as a collar of a shirt, by the main hot plate part 210 of which one end is formed to be narrow in the other direction.

The hot plate cover part 300 includes an auxiliary hot plate 310 formed with an auxiliary steam outlet 311. Further, the hot plate cover part 300 is detachably coupled with the body part 100.

The auxiliary steam outlet 311 formed at the auxiliary hot plate 310 may be shaped like an elongated hole elongated in a longitudinal direction, in which the plurality of main steam outlets 221 is formed, so as to accommodate the plurality of main steam outlets 221 formed at the main hot plate part 210.

Particularly, the hot plate cover part 300 may further include a frame 330 and grips 340.

The frame 330 may be coupled with an outer peripheral portion of the auxiliary hot plate 310 to support the auxiliary hot plate 310.

A plurality of grips 340 is formed at one side of the frame 330 to enable the hot plate cover part 300 to be easily detachable.

Further, the steam iron 10 according to the exemplary embodiment of the present invention may further include a coupling part 500 for detachably coupling the hot plate cover part 300 to the body part 100.

Particularly, the coupling part 500 may further include a coupling recess 510 formed at a lower portion of the body part 100, to which the main hot plate part 210 is coupled, a coupling protrusion 530 formed at one side of the frame 330 and protruding to be engaged with the coupling recess 510, and a locking member 520 pressurizing one side of the coupling protrusion 530 when the coupling protrusion 530 is engaged with the coupling recess 510 to maintain the engagement state of the coupling recess 510 and the coupling protrusion 530.

Accordingly, when the hot plate cover part 300 is mounted in the body part 100, the engagement of the coupling recess 510 and the coupling protrusion 530 is maintained by the locking member 520.

Further, when the user slides the locking member 520 in a predetermined direction, the engagement of the coupling recess 510 and the coupling protrusion 530 may be released. When the engagement is released, the user may detach the hot plate cover part 300 from the body part 100 of the steam iron 10.

Particularly, when the hot plate cover part 300 is mounted in the body part 100, the auxiliary hot plate 310 is coupled so as to face the main hot plate part 210. That is, the auxiliary hot plate 310 is coupled with the main hot plate part 210 so that the plurality of main steam outlets 221 faces the auxiliary steam outlet 311.

Further, the auxiliary steam outlet 311 may be formed to have a larger width than that of the main steam outlet 221 so that the steam discharged from the main steam outlet 221 may be effectively discharged without a collision with the auxiliary steam outlet 311.

Further, when the hot plate cover part 300 is mounted in the body part 100 of the steam iron 10 according to the exemplary embodiment of the present invention, the main hot plate part 210 installed at the body part 100 and the auxiliary hot plate 310 of the hot plate cover part 300 are disposed to be spaced apart from each other while facing each other. That is, the hot plate cover part 300 covers the main hot plate part 210.

As illustrated in FIG. 3, the auxiliary hot plate 310 may be heated by heat energy generated by the spaced main hot plate part 210. That is, the auxiliary hot plate 310 is heated by receiving heat energy generated by the main hot plate part 210 by an indirect method, such as convection or radiation.

Accordingly, when the main hot plate part 210 is heated, the auxiliary hot plate 310 has a lower temperature than that of the main hot plate part 210.

Particularly, when the hot plate cover part 300 is mounted in the body part 100, the user may crimp the cloth by using the auxiliary hot plate 310 to which heat energy is indirectly transmitted by the main hot plate part 210.

For example, the auxiliary hot plate 310 may include a metal having greater thermal conductivity than that of the main hot plate part 210.

Accordingly, when the hot plate cover part 300 is mounted in the body part 100, the steam iron 10 may iron by using the auxiliary hot plate 310 having a temperature lower than that of heat generated by the main hot plate part 210 by the auxiliary hot plate 310 spaced apart from the main hot plate part 210.

That is, it is possible to crimp cotton and hemp at an ironing temperature (180° C. to 200° C.) by using the main hot plate part 210 installed at the body part 100. Further, when the hot plate cover part 300 is mounted in the body part 100, it is possible to crimp rayon, silk, or synthetic cloth, at an ironing temperature (150° C. to 120° C.) by using the auxiliary hot plate 310 having a lower temperature than that of the main hot plate part 210.

Accordingly, the steam iron 10 of the present invention may iron by using the auxiliary hot plate 310 having a relatively lower temperature than that of the main hot plate part 210, thereby preventing a problem in that cloth made of rayon, silk, or synthetic fiber having a low ironing temperature is damaged due to a high temperature of the hot plate by the heated hot plate of the steam iron in the related art during ironing.

That is, when the user crimps the cloth by mounting the hot plate cover part 300 to the body part 100, the auxiliary hot plate 310 having a relatively low temperature, not the main hot plate part 210, is in direct contact with the fiber, such as rayon, silk, or synthetic fiber having a low ironing temperature, thereby preventing the cloth from being damaged.

Further, even when the hot plate cover part 300 is mounted in the body part 100, the steam is sprayed through the auxiliary steam outlet 311, thereby ironing the wrinkles of the cloth with the steam.

Further, since the hot plate cover part 300 is indirectly heated by the main hot plate part 210, a separate heat generating device, such as a hot wire, is not necessary, so that the hot plate cover part 300 is easily detachable.

Further, the hot plate cover part 300 according to the exemplary embodiment of the present invention may further include an airtight part 400.

The airtight part 400 may guide the steam discharged from the main steam outlets 221 to the auxiliary steam outlet 311.

That is, the airtight part 400 may be formed so as to prevent the steam discharged through the main steam outlets 211 from flowing into a space between the main hot plate part 210 and the auxiliary hot plate 310, which are spaced apart from each other, when the hot plate cover part 300 is mounted in the body part 100 and the steam discharged from the main steam outlets 221 is discharged to the auxiliary steam outlet 311.

Accordingly, the airtight part 400 is formed at one side of the auxiliary steam outlet 311 to guide the steam discharged through the plurality of main steam outlets 221 to be discharged through the auxiliary steam outlet 311.

Further, the airtight part 400 according to the exemplary embodiment of the present invention may further include a seal member 410 and a bracket part 420 as illustrated in FIG. 4.

The seal member 410 may be installed at one side of an outer peripheral surface of the auxiliary steam outlet 311, and may be installed while protruding in a direction, in which the hot plate cover part 300 is mounted in the body part 100.

That is, when the hot plate cover part 300 is mounted in the body part 100 by the user, one end of the seal member 410 may be in contact with the main hot plate part 210, and the other end thereof may be coupled with the auxiliary hot plate 310.

As one example, the seal member 410 may be made of a material which has elasticity, minimally deforms at a high temperature, and has excellent airtight and watertight performance.

Further, the seal member 410 may be formed to have a protruding height of 2 mm to 6 mm.

When the seal member 410 is formed to have a protruding height of less than 2 mm, a part of the steam sprayed from the main steam outlets 221 may flow into a space between the spaced main hot plate part 210 and auxiliary hot plate 310.

Further, when the seal member 410 is formed to have a protruding height of more than 6 mm, a spaced distance between the main hot plate part 210 and the auxiliary hot plate 310 may be increased, so that the sprayed steam may be condensed by a temperature of the auxiliary hot plate 310 having a relatively lower temperature than that of the main hot plate part 210. Accordingly, a stain may be generated in the cloth by the condensed water during ironing.

The bracket member 420 pressurizes one surface of the seal member 410 so that the seal member 410 is coupled to the auxiliary hot plate 310, thereby fixing the seal member 410 to the auxiliary hot plate 310.

Accordingly, the seal member 410 may be coupled to the auxiliary hot plate 310 by the bracket member 420, and effectively guide the steam discharged from the main steam outlets 221 to be discharged through the auxiliary steam outlet 311.

Particularly, an outer peripheral surface of the auxiliary steam outlet 311 is formed to be bent in a direction where the hot plate cover part 300 is coupled with the body part 100, and cover part coupling recesses 312 may be formed on the outer peripheral surface of the bent auxiliary steam outlet 311. Further, a plurality of cover part coupling recesses 312 may be formed.

The seal member 410 may be disposed on the outer peripheral surface of the bent auxiliary steam outlet 311, and seal coupling holes 412 may be formed so as to face the cover part coupling recesses 312.

The bracket member 420 may be formed with bracket protrusions 422 engaged with the cover part coupling recesses 312 through the seal coupling holes 712.

Accordingly, the seal member 410 may effective engage the auxiliary hot plate 310 formed with the cover part coupling recesses 312 with the seal member 410 formed with the seal coupling holes 412 by the bracket member 420 formed with the bracket protrusions 422.

According to the aforementioned configuration, the steam iron 10 according to the exemplary embodiment of the present invention may be easily moved and kept, and crimp cloth while preventing cloth from being damaged.

The exemplary embodiments of the present invention have been described with reference to the accompanying drawings, but those skilled in the art will understand that the present invention may be implemented in another specific form without changing the technical spirit or an essential feature thereof.

Accordingly, it shall be construed that the aforementioned exemplary embodiments are illustrative in all aspects, and are not restrictive, and the scope of the present invention shall be defined by the accompanying claims, and it shall be construed that the meanings and the scopes of the claims, and all changes or modified forms induced from the equivalent concepts thereof are included in the scope of the present invention.

What is claimed is:

1. A steam iron, comprising:

a body part in which a water tank for storing water and a steam generating device for converting water supplied from the water tank into steam are installed;

a main hot plate part which is installed at one side of the body part and formed with a plurality of main steam outlets for discharging steam generated by the steam generating device; and a hot plate cover part which includes an auxiliary hot plate formed with an auxiliary steam outlet through which steam discharged from the plurality of main steam outlets is discharged, and is detachably coupled with the body par, wherein the hot plate cover further includes an airtight part which guides steam discharged from the plurality of main steam outlets to the auxiliary steam outlet, wherein the airtight part further includes a seal member which is installed to protrude at one side of an outer peripheral surface of the auxiliary steam outlet, and a bracket which couples the seal member to the auxiliary hot plate.

2. The steam iron of claim 1, wherein the auxiliary hot plate—is spaced apart from the main hot plate part—in a state where the hot plate cover part is mounted in the body par, and is heated by receiving heat energy generated by the main hot plate part.

3. The steam iron of claim 1, wherein the body part-further includes a continuous steam spray button part by which steam is continuously discharged from the plurality of main steam outlets.

4. The steam iron of claim 3, wherein the body part further includes a light unit which emits light when steam is continuously discharged from the plurality of main steam outlets by an operation of the continuous steam spray button part.

* * * * *